United States Patent [19]

Pool

[11] Patent Number: 4,553,710

[45] Date of Patent: Nov. 19, 1985

[54] ROLL HOLDING FIXTURE

[75] Inventor: Daniel L. Pool, Phoenix, Ariz.

[73] Assignee: PC Manufacturing Corporation, Phoenix, Ariz.

[21] Appl. No.: 523,434

[22] Filed: Aug. 16, 1983

Related U.S. Application Data

[63] Continuation-in-part of Ser. No. 357,624, Mar. 12, 1982, abandoned, which is a continuation-in-part of Ser. No. 205,233, Nov. 10, 1980, abandoned.

[51] Int. Cl.[4] ..... B65H 19/04

[52] U.S. Cl. ..... 242/55.2; 242/55.53

[58] Field of Search ..... 242/55.2, 55.3, 55.53, 242/129.5, 129.51; 225/46, 47, 77

[56] References Cited

U.S. PATENT DOCUMENTS

| | | | |
|---|---|---|---|
| 1,913,363 | 6/1933 | Allen | 242/55.2 |
| 2,220,230 | 11/1940 | Gilbert | 242/68 |
| 2,643,069 | 6/1953 | Carlin | 242/55.53 |
| 3,433,433 | 3/1969 | Pospisil et al. | 242/129.51 |
| 3,878,998 | 4/1975 | Lazzari | 242/55.2 |
| 3,986,677 | 10/1976 | Ootaki et al. | 242/55.53 |

*Primary Examiner*—Leonard D. Christian
*Attorney, Agent, or Firm*—Don J. Flickinger

[57] ABSTRACT

A pair of support arms extend from a base adapted to be attached to a selected surface. The arms are spaced apart to receive a roll of coiled sheet material, such as toilet tissue or paper towels therebetween. A pair of opposed fingers, carried by the support arms rotatably support the roll. The fingers, which are biased to enter the hollow core of the roll are deflectively movable in separable directions in response to urging of the roll to receive the roll therebetween.

10 Claims, 26 Drawing Figures

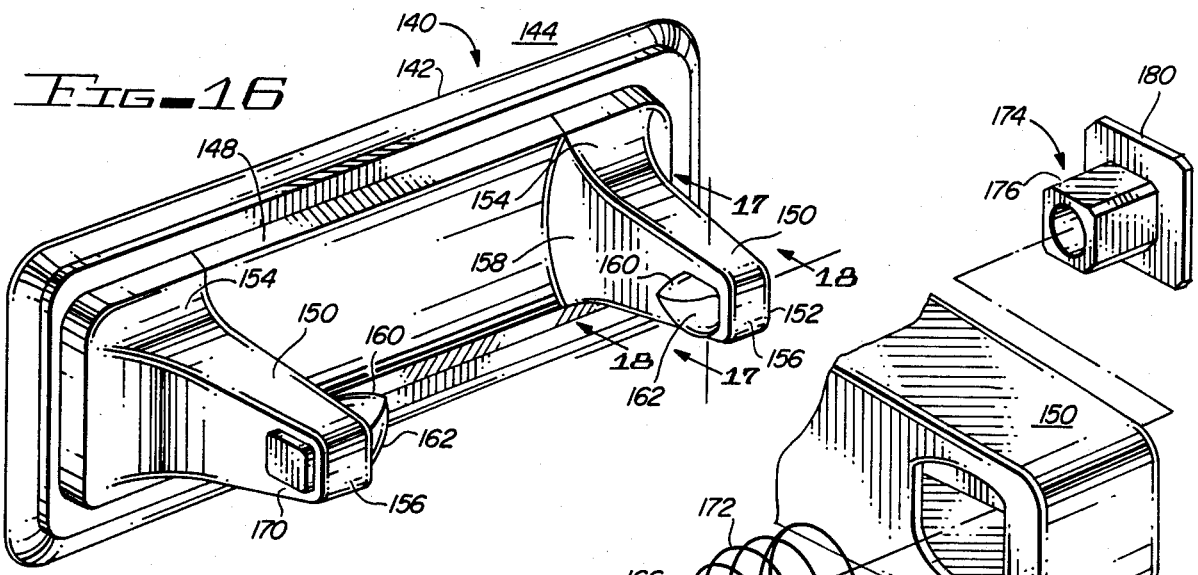
FIG-16
FIG-17
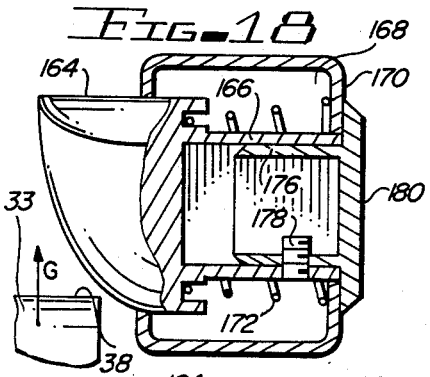
FIG-18
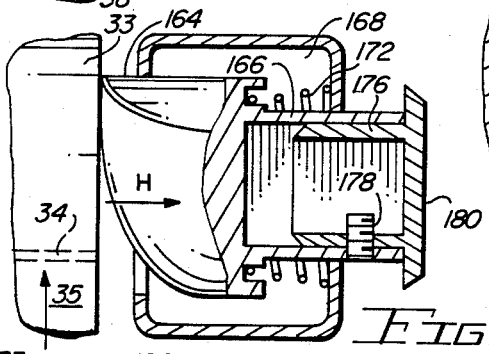
FIG-19
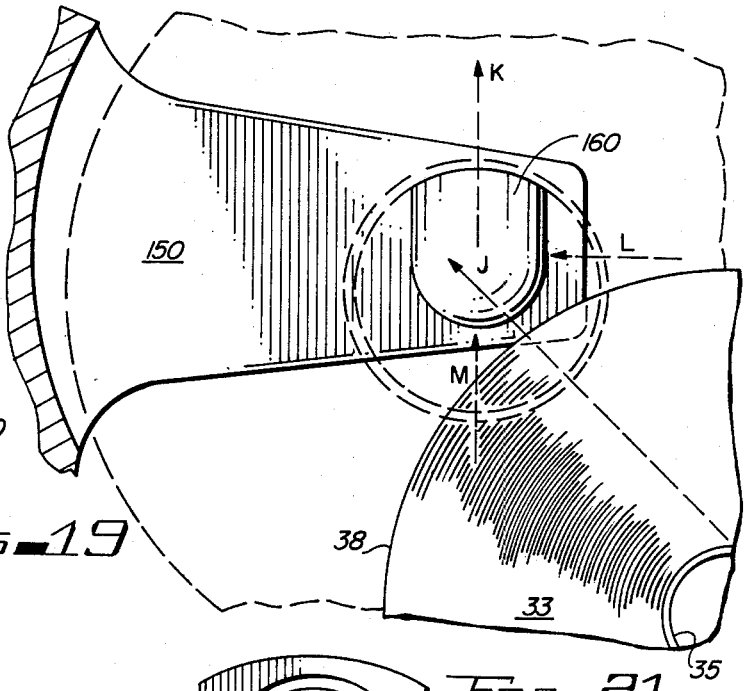
FIG-21
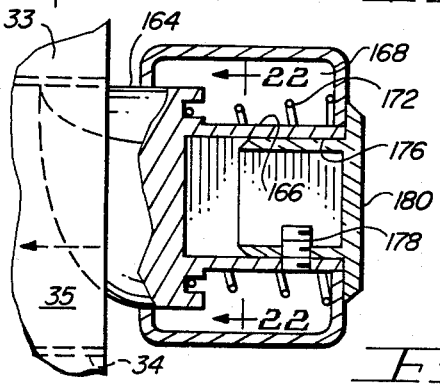
FIG-20
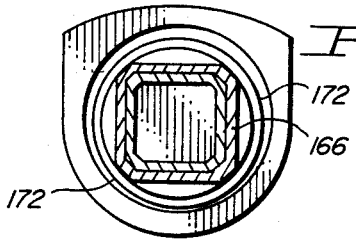
FIG-22

ROLL HOLDING FIXTURE

CROSS REFERENCE TO RELATED APPLICATION

This application is a continuation-in-part of application Ser. No. 357,624 filed Mar. 12, 1982 now abandoned which was a continuation-in-part of application Ser. No. 205,233 filed Nov. 10, 1980 and now abandoned.

FIELD OF THE INVENTION

This invention relates to holding and dispensing fixtures.

In a further aspect, the present invention relates to devices for rotatably supporting a cylindrical roll of coiled sheet material, such as paper towels, toilet tissue and the like.

More particularly, the instant invention concerns a holding and dispensing device having improved means for mounting the roll.

BACKGROUND OF THE INVENTION

Various commercially available products are commonly packaged and distributed as rolls of sheet material. The material, which is coiled about a hollow core, usually a cardboard tube, is frequently perforated to define readily separable sheets. Toilet tissue and paper towels are well known exemplary products. Wrapping paper, wax paper, metal foil and plastic sheets are other representative materials.

The prior art is replete with various types of devices for holding the roll and dispensing the material as a continuous sheet. Commonly, the devices are in the form of a fixture notably located in residential and commercial bathrooms and kitchens. The fixtures are usually attached to any conveniently suitable surface such as a wall, the underside of a shelf or the backside of a door.

Several prior art configurations have achieved commercial success. Particularly prevalent is a fixture having a base with a pair of projecting arms or support members. The base, which is attached to the supporting surface by various means including adhesives and mechanical fasteners, may be substantially flat or, optionally, be formed with a recess for partially receiving the roll. The arms are spaced apart an appropriate distance to receive the ends of the roll therebetween. Roll holding means are carried by the arms.

Two types of roll holding means are especially well known. The first type is in the form of an elongate cylindrical element having a pair of telescoping components normally urged apart in response to an enclosed spring. The ends of the elemement are received within appropriately sized sockets located near the free ends of the respective arms. The arms are rigid and the spring-loaded telescoping member is removed and replaced during mounting of the roll. The second style includes a stub shaft or bearing element rigidly affixed proximate the free end of each arm. The arms are movable, usually resiliently deflective, for the purpose of removing the empty core and mounting a replacement roll.

The foregoing types of fixtures, in which the roll is freely removable, are especially adapted for private use. To provide for public accommodation, various "theft-proof" fixtures are commercially available. In general, such fixtures encase the roll within a locking cabinet having an opening or slot through which the sheet projects. Fixtures of the immediate type are noticeably found in public restrooms.

It is immediately apparent that mounting a roll upon the above types of fixtures requires considerable manual dexterity and the cooperative use of both hands. The removal of the telescoping element, in connection with the first type of holder, requires that the user insert a finger between the end of the roll and the arm in order to shorten the telescoping element against the force of the spring sufficiently to be removed from the retaining sockets. A laborious task for any, the operation may become impossible for those with impaired hand use. The resilient arm type of unit is substantially easier to load, however, there is the ever present threat that the roll will become dislodged as the material is withdrawn and separated. The mounting of a roll upon a theft-proof type device requires the necessity of carrying a key or special loading tool and the expenditure of considerable time. Further, such devices tend to be relatively expensive.

Numerous other configurations, although not necessarily achieving commercial success, have been proposed by the prior art. Like the above described roll holding and dispensing fixtures, none have provided an entirely satisfactory solution.

It would, therefore, be exceedingly advantageous to remedy the deficiencies inherent of the prior art.

Accordingly, it is an object of the present invention to provide an improved fixture for holding a roll of coiled sheet material.

Another object of the invention is the provision of a roll holding fixture having improved means for mounting the roll.

And another object of the invention is to provide a roll holding fixture in which a spent roll can be easily and conveniently replaced.

Still another object of the invention is the provision of a fixture which is readily manipulated by an unencumbered one-handed operation.

Yet still another object of the instant invention is the provision of a fixture which can be variously oriented, such as for right-handed or left-handed use upon vertical or horizontal surfaces.

A further object of the invention is to provide a roll holding fixture adapted for private or commercial use.

Still a further object of the immediate invention is the provision of a fixture having structure suitable for holding rolls of various lengths.

Yet still a further object of the invention is to provide a fixture which will firmly and securely support a roll for rotatable dispensing of the sheet material.

Yet still a further object of the invention is the provision of a fixture, according to the above, having improved simplified design for economical manufacture and maintenance-free use.

SUMMARY OF THE INVENTION

Briefly, to achieve the desired objects of the instant invention, in accordance with a preferred embodiment thereof, first provided is a base securable to a selected surface. A pair of support members are carried by the base and spaced apart to receive the ends of a roll therebetween. Further provided is a pair of opposed support elements for rotatably supporting a roll along an axis extending between the support members. One of the support elements is movably carried by each of the support members.

In accordance with a further embodiment of the invention, the support members are in the form or rigid arms immovably fixed to the base. The support elements are in the form of fingers, one carried by each arm, which are deflectively movable in separate directions in response to movement of the roll between the arms. The fingers are biased by gravity or spring to enter the hollow core of the roll at a predetermined position of movement of the roll.

In accordance with an even further embodiment of the invention, each finger moves about a pivotal axis and is received within a recess within the respective arm in response to the deflectable separation at the urging of the roll. The orientation of the axis may be adjusted with respect to the arm to complement the surface upon which the base is secured.

In accordance with still another embodiment of the invention, each finger is of generally cylindrical shape having a pedestal member that extends through a recess formed in the support arm. A spring is attached between an inner wall forming the stop of the recess about the pedestal member and the outwardly extending end of the finger. The extending end of the finger is of generally convexed shape and has a flat surface facing the base. Each finger is deflected within the respective recess to compress the spring as the roll is urged against the convexed end thereof. The fingers are snapped into the hollow core of the roll as the core comes into alignment therewith to securely hold the roll therebetween.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings, in which:

FIG. 16 is a perspective view of yet another roll holding fixture embodying the principles of the instant invention;

FIG. 17 is an exploded view of one of the support members shown in FIG. 16;

FIGS. 18, 19, 20 are enlarged fragmentary sectional views taken along line 18—18 of FIG. 16 and illustrating the displacement of the support elements during mounting of a roll;

FIG. 21 is an elevation view illustrating the directions of movement of a roll for installation and removal;

FIG. 22 is a cross-sectional view illustrating in more detail the interrelationship of the components of each of the mounting elements;

DESCRIPTION OF THE PREFERRED EMBODIMENT

Figure 1:
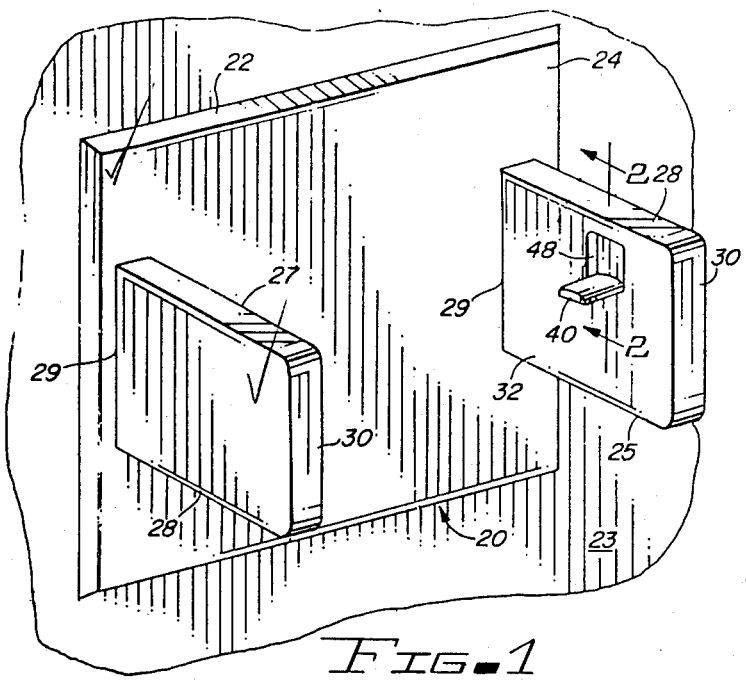
FIG. 1 is a perspective view of a roll holding fixture constructed in accordance with the teachings of the instant invention.

Turning now to the drawings in which like reference characters indicate corresponding elements throughout the several views, attention is first directed to FIG. 1 which illustrates a roll holding and dispensing fixture of the instant invention, generally designated by the reference character 20, having base 22 secured to surface 23. Base 22 includes a rear surface (not herein specifically illustrated) which abuts surface 23 and a front surface 24. Bases of the immediate type, being well known in the prior art, are readily attached to any selected surface, such as a wall, door, or shelf, in accordance with conventional fastening techniques, such as adhesives or mechanical devices. The configuration of base 22 and the means of attachment to the selected surface are not germane to the instant invention. However, for purposes of the ensuing discussion, it is considered that surface 24 generally defines a plane substantially parallel to the plane of surface 23.

A pair of support members 25 and 27 extend from base 22. Each support member 25 and 27 is in the form of a rigid arm 28 having fixed end 29 immovably secured to surface 24, a free end 30 and an inner surface 32. Inner surfaces 32 are opposed and spaced apart a distance to receive the ends of a roll of coiled sheet material therebetween. By way of illustration but not limitation, roll, as used herein, refers to various commercially available products such as toilet tissue, paper towels, metal foil and plastic sheet commonly found in residential and commercial bathrooms and kitchens. Such rolls are commercially available in various lengths and diameters. It is within the scope of the instant invention that the specific embodiments thereof be appropriately dimensioned.

Figure 2:
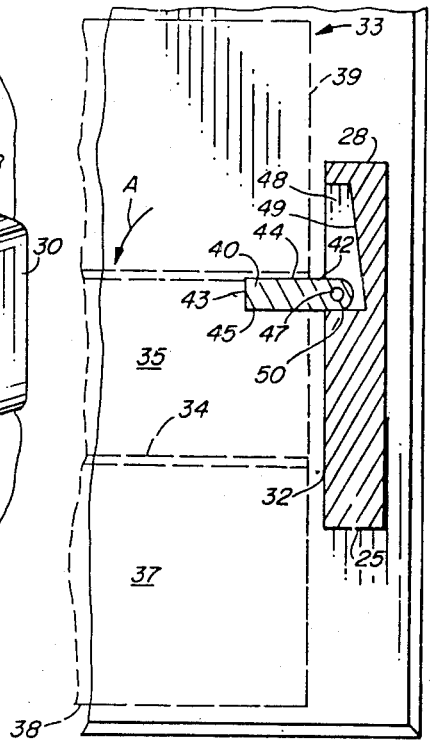
FIG. 2 is an enlarged partial vertical sectional view taken along the line 2—2 of FIG. 1 and particularly illustrating the device as it would appear when supporting a roll, the roll being shown in broken outline.
Figure 3:
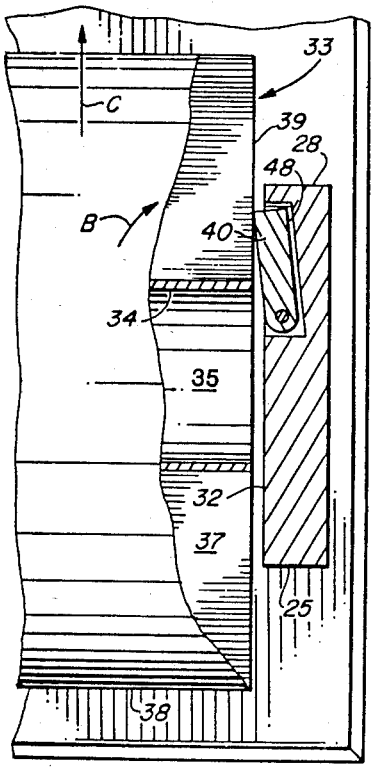
FIG. 3 is a view generally corresponding to the illustration of FIG. 2 illustrating the arrangement of the elements as they would appear during mounting of the roll.

A typical roll, generally designated by the reference character 33, is seen in FIGS. 2 and 3. Roll 33 includes elongate hollow core 34, conventionally fabricated of cardboard, having bore 35 therethrough. Sheet material 37, coiled about core 34, terminates with outer cylindrical surface 38. Roll 33 further includes spaced apart ends 39, only one herein specifically illustrated. As the roll is rotated, the sheet material is continuously dispensed. Certain types of sheet material, notably toilet tissue and paper towels, are periodically perforated for ease of separation by the user.

A pair of opposed support elements for rotatably supporting roll 33 are carried by support members 25 and 27. The roll is held along a support axis extending between support members 25 and 27 substantially parallel to base 22. Eech support element includes a finger 40, fixed end 42, free end 43, normally upper surface 44 and normally lower surface 45. Fixed end 42 is pivotally secured to arm 28 by pin 47 which extends along a substantially horizontal axis. It is noted that the axis of pin 47 is concurrently perpendicular to the support axis of roll 33 and the plane of base 22. A portion of finger 40, proximate fixed end 42 and pin 47, resides within recess 48 having inner surface 49 and lower surface 50. Surface 50 is substantially horizontal. Surface 49 extends upwardly inward at an angle less than 90° from surface 50.

Although not specifically herein illustrated, it is understood that mirror image structure is carried by support member 27.

FIG. 2 illustrates finger 40 as it would appear in the support position for holding roll 33. Surface 50 functions as stop means for the abutment of surface 45 to limit the movement of finger 40 in the direction of arrowed line A about pin 47 to a substantially horizontal first position. Finger 40 is received within bore 35 and core 34 rests upon surface 44. To facilitate rotation of roll 33, surface 44 may be arcuate in cross-section.

FIG. 3 illustrates the position of finger 40 during the mounting of roll 33. Recess 48 is dimensioned to receive finger 40. Surface 49 serves as stop means for the abutment of surface 44 to limit the movement of finger 40 to a less than vertical second position. As specifically shown in FIG. 1, finger 40 assumes the position illustrated in FIG. 2 when a roll is not supported thereon. Roll 33 is mounted upon holder 20 in response to upward movement in the direction of arrowed line C beginning at a point below finger 40. In response to movement of roll 33 in a direction of arrowed line C, outer cylindrical surface 38 and, subsequently end 39, abuts and moves against surface 45 urging finger 40 in a direction of arrowed line B into recess 48 as seen in FIG. 3. Continued movement of roll 33 in a direction of arrowed line C brings bore 35 of core 34 in alignment with finger 40. No longer held in the second position by roll 33, finger 40 falls in response to the force of gravity, pivoting about pin 47 into position A. After the movement of finger 40 to the first position, core 34 is supportable upon surface 44. The removal of roll 33, or core 34, after depletion of sheet material 37, is in response to further movement in the direction of arrowed line C.

Figure 4:
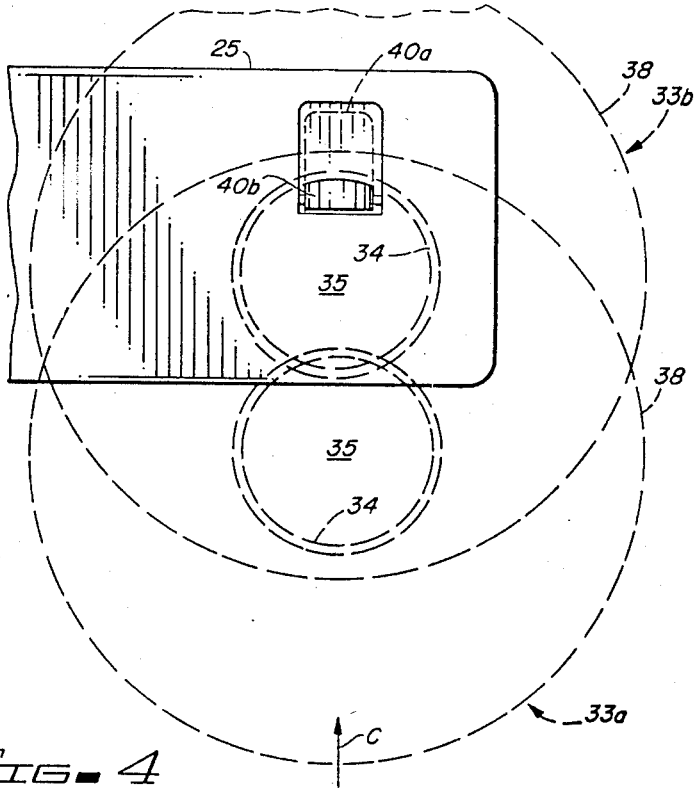
FIG. 4 is a composite illustration of the structure of FIGS. 2 and 3 as it would appear when viewed from the left-hand side thereof.

The mounting of roll 33 upon holder 20, as described in the foregoing discussion, is semi-schematically illustrated in FIG. 4. The positions of roll 33 and finger 40 during an intermediate stage of mounting are designated by the reference characters 33*a* and 40*a*, respectively. It is understood that during the mounting of roll 33, the complementary support element, carried by support member 27, moves similarly to the support member specifically described. In response to the urging of roll 33 during movement in the direction of arrowed line C, the pair of support elements are deflectively moved in separable directions to receive the roll therebetween. The slope of surface 48 assures that finger 40 remains biased to move in the direction of arrowed line A in response to the force of gravity in the absence of pressure applied by roll 33.

Figure 5:
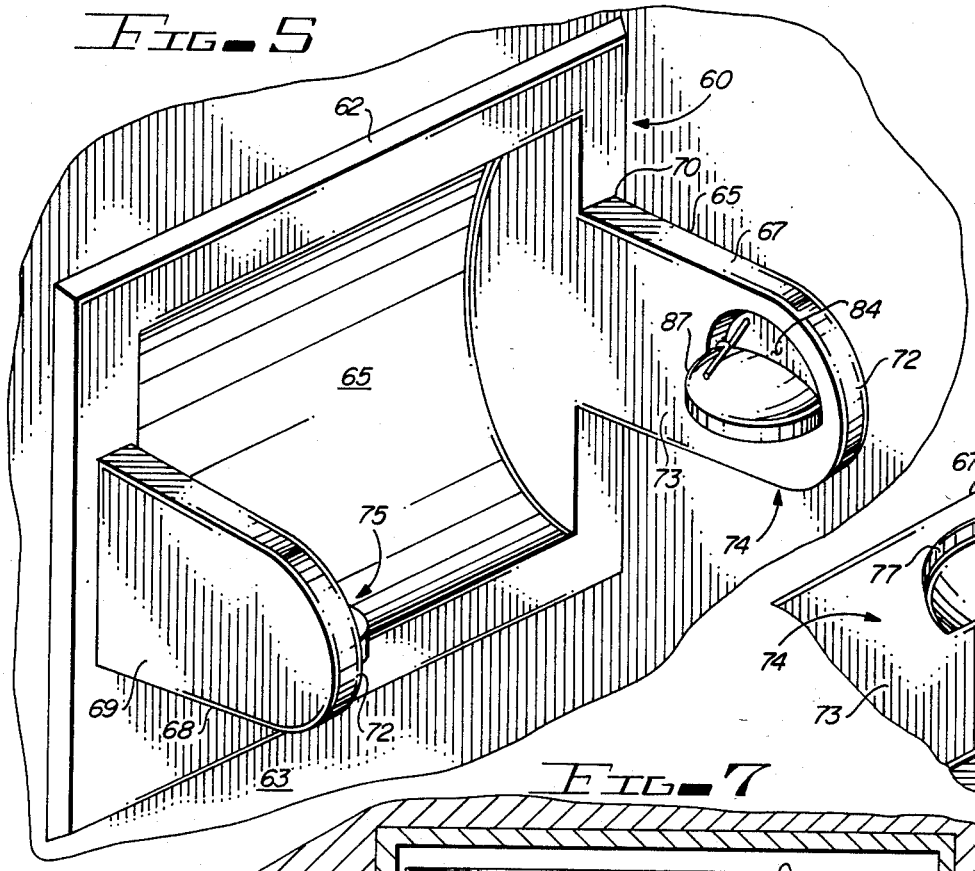
FIG. 5 is a perspective view of an alternate roll holding fixture embodying the principles of the instant invention.

FIG. 5 illustrates an alternate embodiment of the instant invention generally designated by the reference character 60 having base 62 secured to surface 63 as previously described in connection with the embodiment generally designated by the reference character 20. It is contemplated by the instant invention that the various embodiments thereof may be used with either a flush mounted type base, typified by base 22, or alternately, a recess type base such as illustrated by base 62.

Analogous to the previously described embodiment, and in accordance with conventional practice, a pair of support members 67 and 68 project from base 62. Each support member 67 and 68 comprises a rigid arm 69 having a fixed end 70 immovably secured to surface 64, a free end 72 and an inner surface 73. Inner surfaces 73 are spaced apart to receive the ends 39 of roll 33 therebetween.

A pair of support elements 74 and 75 are carried by respective support members 67 and 68. In general similarity to the previously described support elements, support elements 74 and 75 are opposed and extend inwardly to support roll 33 along an axis extending between support members 67 and 68 and generally parallel.

Figure 6:
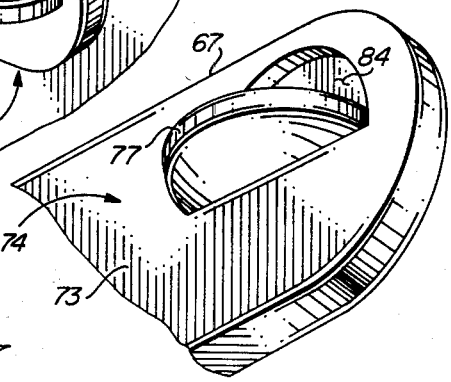
FIG. 6 is a perspective view of a portion of the device shown in FIG. 5.
Figure 7:
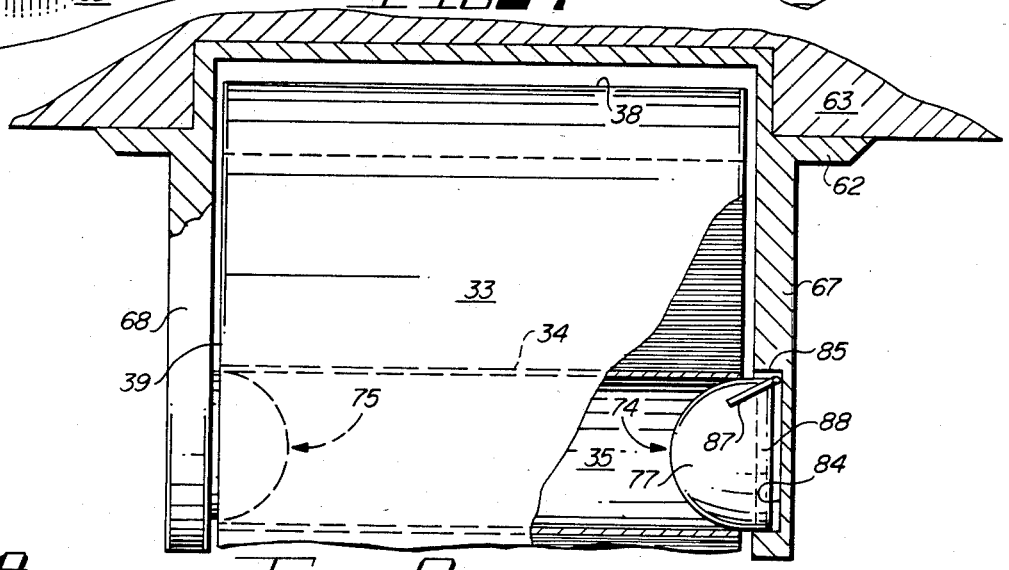
FIG. 7 is a partial sectional view of the device illustrated in FIG. 6.

Support element 74 is described in further detail with additional reference to FIGS. 6 and 7. It is understood that support element 75, being a mirror image of support element 74, includes analogous structure. Support element 74 includes finger 77 having fixed end 78, free end 79, upper surface 80 and lower surface 82. While a semicircular shape has been chosen for purposes of illustration, it will be appreciated that finger 77 may assume any desired configuration. Fixed end 78 is pivotally connected to arm 67 by pin 83. Normally, a portion of finger 77, adjacent end 78, resides within recess 84 formed within surface 73 and sized and dimensioned to receive finger 77. Recess 84 is provided with shoulder 85.

Torsion spring 87, employed in the conventional manner, normally urges surface 82 of finger 77 against shoulder 85. Shoulder 85 functions as stop means for the movement of finger 77 in the direction of arrowed line D, about pin 83 in response to spring 87, to a first position substantially perpendicular to the plane of base 62 to be received within bore 35 of core 34 for supporting roll 33. Finger 77 is moved into a second position, within recess 84, in a direction of arrowed line E, in response to urging of roll 33 in general analogy to the previously described movement of finger 40.

In the embodiment chosen for purposes of illustration, finger 77 is pivotal about an axis generally perpendicular to the support axis of roll 33 and to the plane of base 62. Accordingly, the mounting of roll 33 upon fixture 60 is accomplished by substantially vertical movement of roll 33 in a direction parallel base 62 as indicated by the arrowed line F.

Figure 8:
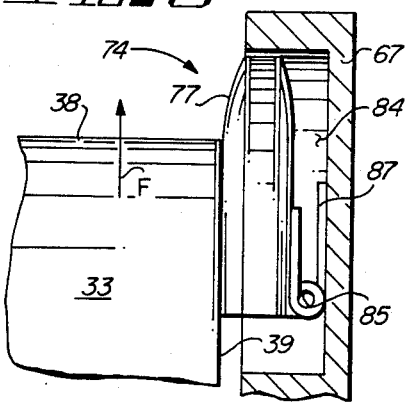
FIG. 8 is a partial plan view of the device of FIG. 5 as it would appear during the mounting of a roll.
Figure 9:
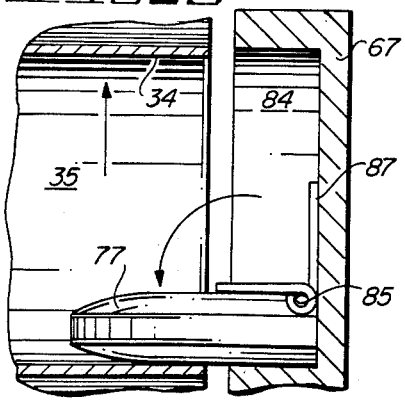
FIG. 9 is a partial plan view of the device of FIG. 5 as it would appear after having a roll mounted thereon.

During initial movement of roll 33, as seen in FIG. 8, outer cylindrical surface 38 abuts fingers 77 deflecting support elements 74 and 75 in separable directions. In response to continued movement of roll 33, finger 77 are urged into the respective recesses 84 by ends 39. As fingers 77 move from the normal position, illustrated in FIG. 5, into the receiving position, illustrated in FIG. 8, torsion springs 87 are compressed. Movement of roll 33 terminates when bore 35 moves to alignment with fingers 77. At this position, springs 87 urge the respective fingers 77 into hollow core 34.

To remove roll 33 from the support elements requires additional movement in the direction of arrowed line F. Such movement is impossible, however, due to the abutment of outer cylindrical surface 38 against base 62. This is a function of the distance between arms 69 and base 62. The distance is such that core 34 can be removed after all, or substantially all, of the sheet material has been uncoiled. Accordingly, the immediate embodiment provides a fixture especially adapted for commercial use wherein theft of a roll is of concern.

Embodiment 60 of the instant invention is especially adapted to be mounted upon either vertical or horizontal surfaces and provide the theft-proof function.

Figure 10:
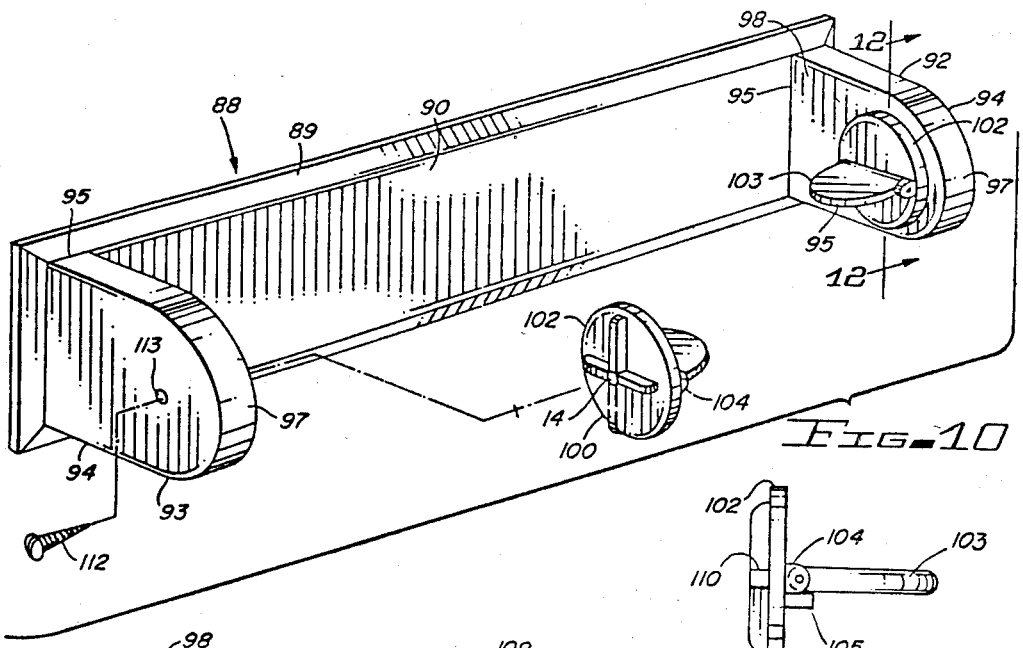
FIG. 10 is a partially exploded perspective view of yet another embodiment of the instant invention.

FIG. 10 illustrates yet another embodiment of the instant invention, generally designated by the reference character 88, having base 89 with front surface 90. Analogous to the previously described embodiments, support members 92, 93, spaced apart to receive the ends of a roll therebetween, extend from base 89. Each support member 92, 93 is in the form of a rigid arm 94 having fixed end 95 secured to surface 90, a free end 97 and an inner surface 98.

Figure 11:
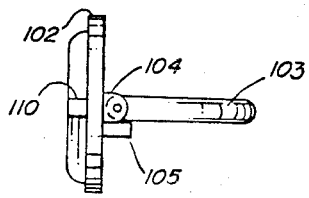
FIG. 11 is an enlarged elevation view of the roll holding element of the device of FIG. 10.
Figure 12:
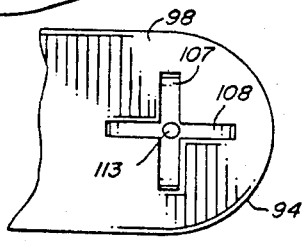
FIG. 12 is a vertical sectional view taken along the line 12—12 of FIG. 10.
Figure 13:
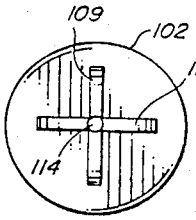
FIG. 13 is an elevation view taken from the left-hand end of the illustration of FIG. 11.

The immediate embodiment includes support elements 99, 100 which are selectively rotatably positionable 35 about the support axis of the roll. Each support element 99, 100, being identical and interchangeable, includes a carrier 102 to which finger 103 is pivotally affixed by pin 104. With further reference to FIG. 11, it is seen that each finger 103 is held in the first position by stop 105 projecting from carrier 103. Fingers 103 receive and hold the roll in accordance with the function and operation previously set forth in connection with the corresponding elements of the embodiment of FIGS. 1–4.

A socket comprising grooves 107 and 108 is formed into the inner surface 93 of each arm 94. Groove 107 is perpendicular to groove 108. The grooves are oriented such that groove 107 lies along an axis substantially parallel to the plane of surface 90 of base 88 and groove 108 lies along an axis which is perpendicular to surface 90. A pair of tongues 109, 110 project from the backside of carrier 102. Each tongue 109, 110 is matingly receivable within each groove 107, 108. The axis of pin 104 is aligned with one of the tongues 109, 110. Accordingly, carrier 102 can be coupled to arm 94 such that the axis of pin 104 is optionally either perpendicular or parallel to the plane of surface 90. A screw 112, passing through opening 113 in arm 94 and threadedly engaging aperture 114 in carrier 102, comprises attachment means for securing the support element to the respective support member. It is seen, therefore, that the immediate embodiment provides a roll holding fixture which can be secured to either vertical or horizontal surfaces and optionally provide the anti-theft function previously described.

Figure 14:
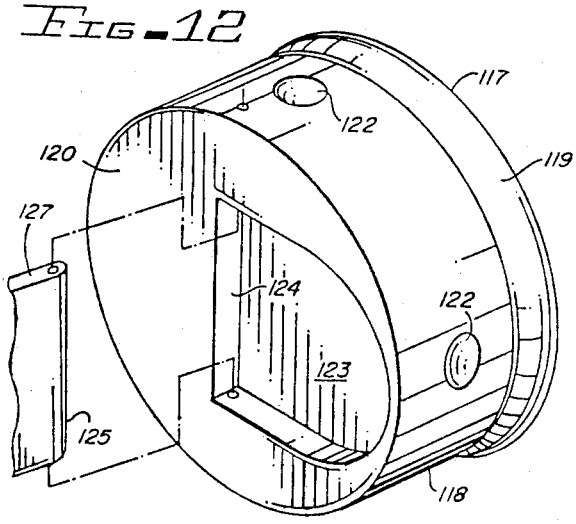
FIG. 14 is an exploded partial perspective view of an alternate roll holding means usable in connection with the embodiment of FIG. 10.
Figure 15:
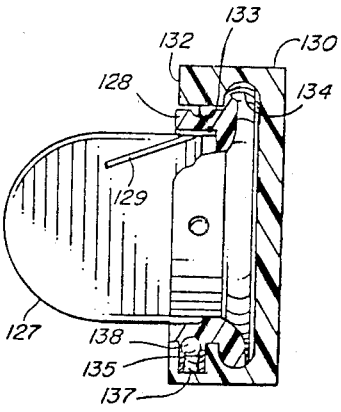
FIG. 15 is a vertical sectional view further illustrating the structure of FIG. 14 as it would appear in combination with the holding fixture of FIG. 10.

FIGS. 14 and 15 illustrate another embodiment of the invention wherein the pivotal axis of the pin is selectively angularly positionable relative the plane of the base. Illustrated in an alternate carrier 117 having cylindrical surface 118, outwardly projecting annular ridge 119 and end 120. A plurality of spaced apart, semispherical identations 112 are formed in surface 118. Recess 123, having shoulder 125, is formed in end 120. Inner end 125, of finger 127, is pivotally secured to carrier 117, within recess 123 by pin 128. Shoulder 124 functions as stop means against which finger 127 abuts in the first position. Torsion spring 129 normally urges finger 127 against shoulder 124. The function of the foregoing components is analogous to the corresponding components set forth in connection with the embodiment of FIGS. 5–9.

Seen in cross-section in FIG. 15 is an arm 130, generally similar to previously illustrated and described arms 94, having inner surface 132. Formed in arm 130, from inner surface 132, is cylindrical bearing surface 133 terminating with annular groove 134. Cylindrical bearing surface 133 and annular groove 134 matingly and rotatably receive cylindrical surface 118 and annular ridge 119, respectively. The elements are readily coupled in snap together fashion during manufacture. Carried in recess 135, extending radially from cylindrical bearing surface 133, is spring 137 and ball 138.

In accordance with conventional detent means, as will be readily apparent to those skilled in the art, ball 138 is urged into a selected socket 112 by spring 137. Accordingly, carrier 117 can be rotated relative arm 130 and retained at any selected position in response to the detent means. Sockets 122 are spaced and oriented relative the axis of pin 128 such that pivotal axis of finger 127 may be positioned either parallel or perpendicular to the plane of base 89.

Turning to FIGS. 16–22, there is illustrated still another embodiment of the subject invention generally designated by the reference character 140 including a base 142 secured to surface 144 as previously described with reference to the other embodiments. Each support member 150 comprises a rigid arm 152 having a fixed end 154 immovably secured to surface 148, a free end 156 and an inner surface 158 analogous to the previously described embodiments.

Each of the pair of support members 150 carry respective and substantially identical support elements 160. Each support element 160 extends inwardly from inner surface 158 of its respective support member 150 and are spaced oppositely apart to form an axis therebetween to support a roll 33 generally parallel to the plane of base 142. The individual support elements 160 are separably and deflectively movable in opposite directions as a roll 33 is urged against convex surfaces 162 so that a roll 33 is received therebetween.

Support elements 160 each comprise a finger 164 integrally coupled to a stem 166. Finger 164 along with stem 166 are fitted into a recess 168 (shown in FIG. 18). A bore is formed through end wall 170 so as to permit passage of stem 166 therethrough against the force of torsion spring 172. A cap 174 having a longitudinal section 176 is telescopically received within stem 166 and is keyed thereto as for example by means of a threaded member 178. Cap 174 also includes a flange-like head 180 which is normally held against wall 170 by means of spring 172 which may be attached at one end to wall 170. Thus, the force of spring 172 will normally cause fingers 164 to extend beyond inner surface 158.

Mounting of a roll 33 is accomplished by urging the outer surface of the roll against surface 162 of fingers 164 in the direction of, for example, arrow G as is shown in FIG. 18. Thus, during the initial movement of roll 33, the outer cylindrical surface 38 will abut fingers 164. By continuing urging roll 33 against fingers 164, each respective finger 164 is deflectively moved in separable directions such that the fingers are depressed into receses 168 in the direction of arrow line H while spring 172 is compressed. Movement of roll 33 terminates when bore 35 moves into alignment with fingers 164. In this case, spring 172 will urge or snap its respective finger 164 into hollow core 34 as is shown in FIG. 20.

FIG. 22 is a cross-sectional view taken along line 22—22 in FIG. 20. It illustrates the telescope relationship betwen stem 166, cap portion 176 and spring 172.

FIG. 21 illustrates that roll 33 may be inserted into the apparatus shown in FIG. 16 by urging it against members 164 in the generally inclined direction indicated by arrow J. Due to the specific curvature of surface 162, the roll may be removed by simply urging or lifting it upward in the direction of arrow K. Movement in both these directions will cause fingers 164 to be recessed since in each case, curved surface 162 will be engaged. It is important to note however, that roll 33 may also be installed by urging it horizontally against support elements 160 as is shown by arrow L or vertically as is shown by arrow M. It should therefore be clear that roll 33 may be installed by urging it against support elements 160 at any angle between the angles represented by arrows L and M. While some difficulty may be encountered if a purely horizontal entry is attempted, installation will be greatly facilitated by only the slightest upward component of movement of the roll against support elements 160.

Figure 23:
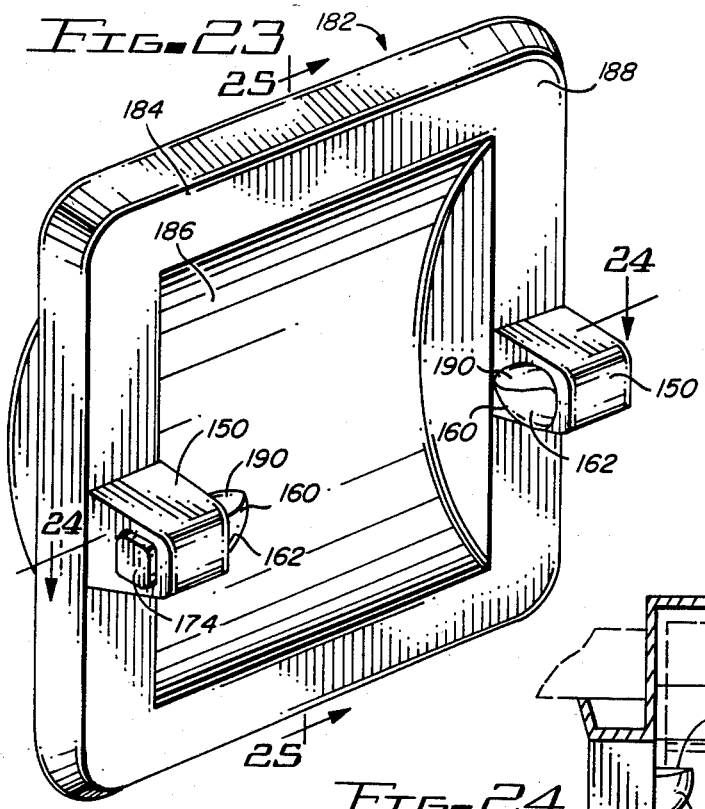
FIG. 23 is a perspective view of yet another roll holding fixture embodying the principles of the instant invention.

FIG. 23 illustrates still another embodiment 182 of the subject invention. It includes a base 184 and a curved recess 186 formed in front surface 188 of base 184 for receiving roll 33 partially therein in a like manner as described for the embodiment illustrated in FIG. 5. Support members 150 and support elements 160 are identical to those shown and described in connection with FIGS. 16–22 and therefore further discussion is not deemed necessary here. Suffice that to say that roll 33 may be installed by simply urging it against support elements 160 and moving roll 33 in direction of arrow P. This will cause these support elements to retract until core 35 of roll 33 comes into alignment with support elements 160. These support fingers of support elements 160 will then snap back into place within bore 35 to support roll 33. In this position roll 33 is partially received by curved surface 186.

Roll 33 may be removed as simply as it was installed. In this case, however, the roll is merely urged in a direction opposite that of arrow P. The convex nature of the support finger will again cause it to be retracted as roll 33 is pulled out.

Figure 24:
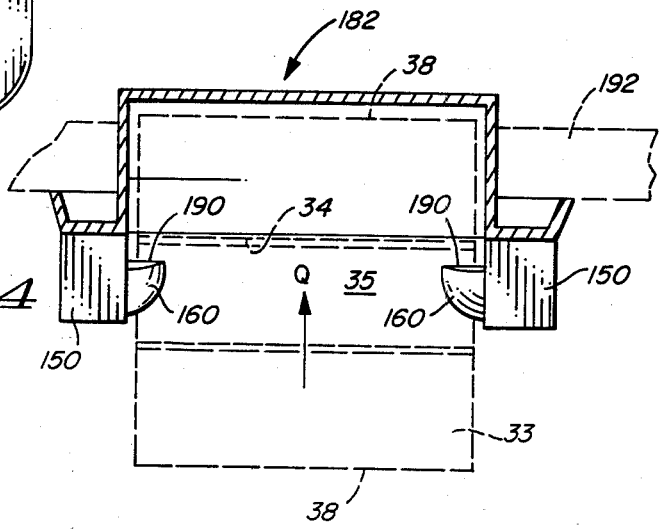
FIG. 24 is a top cross-sectional view taken along line 24—24 in FIG. 23 illustrating how a roll may be inserted into the apparatus shown in FIG. 23.
Figure 25:
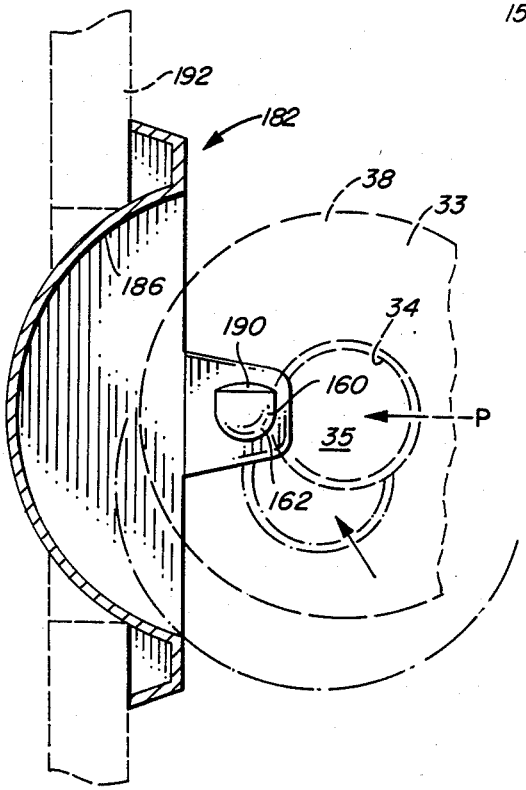
FIG. 25 is a side cross-sectional view taken along line 25—25 in FIG. 23 again illustrating the insertion of a roll into the apparatus.
Figure 26:
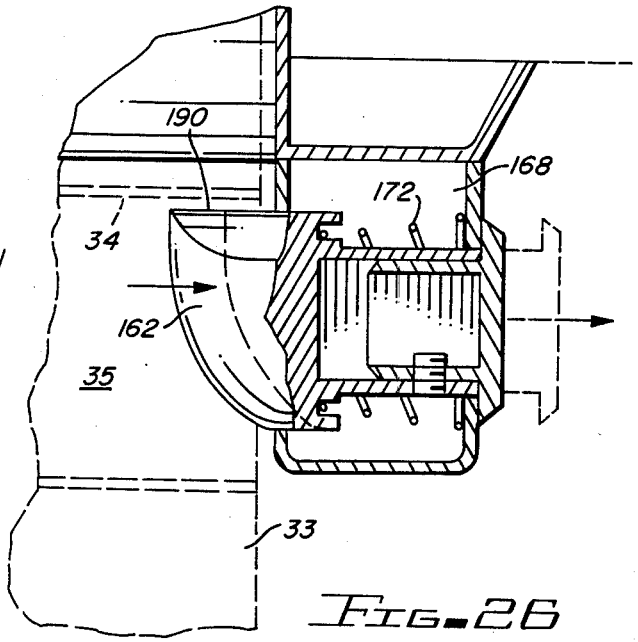
FIG. 26 is a fragmentary cross-sectional view illustrating displacement of the components of the support element during insertion of a roll.

In the embodiment shown in FIGS. 23 and 25, each of the support element fingers includes a flat surface 190 which resides in a plane perpendicular to the plane of surface 192 on which the apparatus is mounted. Thus, roll 33 may be easily installed and removed as described previously since either operation will not result in pressure being exerted against flat surface 190. Only convex surface 162 will be contacted resulting in retraction of the fingers of support element 160. If, however, the fingers could be rotated 90° such that flat surface 190 would reside at a plane parallel to the plane of support surface 192, the apparatus will be suited for use in the commercial environment wherein theft of the roll or sheet material is of concern. This arrangement is shown in FIGS. 24 and 26 where flat surfaces 190 of support elements 160 reside in the plane parallel to that of support surface 192. As can be seen, roll 33 is simply installed by moving the roll in the direction of arrow Q. However, any attempt to remove 33 will result in the wall of hollow core 34 bearing against flat surfaces 190. Retraction of the support elements 160 will not occur and therefore the roll may not be removed.

This situation is shown in more detail in FIG. 26. As can be seen, when roll 33 is inserted, pressure is brought to bear against convex surface 162 causing it to retract within recess 168 as is shown by the dotted lines. It will snap back into position when this falls into alignment with bore 35. Any attempt to remove the roll will cause the wall of hollow core 34 to bear against the flat surface 190. However, this will not cause retraction of the support elements and therefore roll 33 will be locked into position and cannot be removed until substantially all of the sheet material has been consumed.

Various changes and modifications to the embodiments herein chosen for purposes of illustration will readily occur to those skilled in the art. While the several embodiments have been illustrated as various specific designs, the aesthetics or visual impact is not relevant to the scope of the invention. The design of any specific embodiment may assume the design of any other selected embodiment. For example, three specific bases have been illustrated. It is within the scope of the invention that any illustrated base may be used in connection with any selected combination of support members and support arms. More specific elements are also similarly variable. For example, while specifically illustrated as a tongue and groove arrangement, the male-female engagement pair positioningly locating the carrier upon the arm in the embodiment of FIGS. 10–13, could assume alternate configurations such as a square projections and a mating socket. To the extent that such modifications and variations do not depart from the spirit of the invention, they are intended to be included within the scope thereof which determined only by a fair assessment of the following claims.

It is contemplated that the embodiments described herein may be used in an industrial application for holding rolls of toilet paper or paper towels in public restrooms, for example.

Having described my invention in the foregoing specification and the drawings accompanying it in such a clear and concise manner that those skilled in the art may readily and easily practice the invention, I claim that which is set forth in the following claims:

1. A fixture for attachment to a surface and for rotatably holding a roll of coiled sheet material, which roll includes a hollow core, a generally cylindrical outer surface, and a pair of spaced apart ends, such fixture comprising:

a. a base securable to said surface;

b. a pair of support members carried by said base and spaced apart to receive the ends of said roll therebetween;

c. a pair of opposed support elements;

d. pivot means connecting each of said support elements to a respective one of said pair of support members for pivotal rotation between (i) an inwardly extending normal first position to be received within said roll to support said roll along a support axis extending between said support members, and (ii) a separable second position for receiving the end of said roll therebetween in response to urging of said roll to move therebetween, said pivot means extending along an axis substantially perpendicular to the support axis of said roll and selectively angularly positionable relative the plane of said base; and e. a carrier element carried by each of said pair of support members, each said carrier element being selectively rotatably positionable relative said support axis and pivotably carrying a respective one of said pair of support elements.

2. A fixture according to claim 1 further including:

a socket formed in each of said pair of support members for rotatably receiving a respective one of said carrier elements; and detent means for retaining said carrier element at selective rotational positions.

3. A fixture according to claim 2 further including:

an element of a male-female engagement pair carried by each of said pair of support elements;

a complimental element carried by said carrier element and matingly engageable with said element at selectively rotatational positions relative said support axis; and attachment means for holding said element of said male-female engagement pair in engagement with said complemental element.

4. A fixture according to claim 3 wherein said element of said male-female engagement pair includes a first elongate groove and a second elongate groove perpendicular to said first groove; and said complemental element of said male-female engagement pair includes a first elongate tongue and a second elongate tongue perpendicular to said first tongue, said first and second tongues being alternatively receivable within said first and second grooves.

5. A fixture for attachment to a surface for rotatably holding a roll having a hollow core, an outer cylindrical surface and spaced apart ends, the fixture including a base securable to the surface, comprising:

a pair of opposed support members each having a fixed end carried by the base and a free end, said free end having a recess formed therein and a centrally aligned bore which communicates between said recess and an outer surface of said support member, said support members being spaced apart to receive the ends of the roll therebetween; and a pair of opposed support elements for rotatably supporting the roll between said pair of support members, each one of said support elements being deflectively carried within a respective support member and being normally biased to extend inwardly between said support members to be received within the core of the roll, said support elements being deflected in opposite directions inward of said respective support member in response to the urging of the roll which overcomes said bias to allow the roll to be received therebetween, each of said support elements including:

a pedestal member disposed within said recess of said respective support member and having an end extending through said bore;

an end portion fitted to be received within said recess and being attached to the other end of said pedestal member;

biasing means disposed within said recess for causing at least some portion of said end portion to extend from said recess in opposite alignment to said other supporting element;

and an attachment member formed with said end of said pedestal member extending through said bore for maintaining said respective supporting element deflectively disposed within said recess.

6. A fixture according to claim 4, wherein said biasing means includes a spring disposed about said pedestal member between said end portion and the inner end wall formed by said recess, said spring normally biasing said support element inwardly of said respective support member and being compressable to allow such support element to be deflected within said recess in response to the urging of the roll.

7. A fixture according to claim 5 wherein said end portion of each one of said support elements is dimensioned to be fitted within said recess of said respective supporting member and has a flat surface portion along the length thereof with the end thereof extending inwardly of said respective support member being generally convex.

8. A fixture for attachment to a surface and for rotatably holding a roll of coiled sheet material, which roll includes a hollow core, a generally cylindrical outer surface, and a pair of spaced apart ends, said fixture comprising:

a. a base securable to said surface;

b. a pair of support members carried by said base and spaced apart to receive the ends of said roll therebetween;

c. a pair of opposed support elements;

d. pivot means connecting each of said support elements to a respective one of said pair of support members for pivotal rotation between i. an inwardly extending normal first position to be received within said roll to support said roll along a support axis extending between said support members, and ii. a separable second position for receiving the ends of said roll therebetween in response to urging of said roll to move therebetween;

e. stop means for receiving said pair of support elements thereagainst in said first position, said first position being substantially horizontal;

f. a recess in each of said pair of support members for receiving the respective one of said pair of support elements in said second position; and g. biasing means normally urging said pair of support elements against said stop means.

9. A fixture according to claim 8 wherein said pivot means extends along an axis lying in a plane generally parallel to said base and said pair of said support elements are urged into said second position in response to movement of said roll in a direction toward said base.

10. A fixture according to claim 9 wherein said pair of support elements are spaced from said base a distance such that the outer cylindrical surface of said roll abuts said base prohibiting further movement of said roll after said pair of support elements have assumed said first position within said hollow core.

* * * * *

UNITED STATES PATENT AND TRADEMARK OFFICE

CERTIFICATE OF CORRECTION

PATENT NO. : 4,553,710

DATED : 19 November 1985

INVENTOR(S) : Daniel L. Pool

It is certified that error appears in the above—identified patent and that said Letters Patent is hereby corrected as shown below:

Column 12, line 12, after "claim" delete "4" and substitute therefor --5--.

Column 12, line 20, after "claim" delete "5" and substitute therefor --6--.

Signed and Sealed this

Twenty-fourth Day of March, 1987

*Attest:*

DONALD J. QUIGG

*Attesting Officer*

*Commissioner of Patents and Trademarks*